US009631837B2

(12) United States Patent
Doyama et al.

(10) Patent No.: US 9,631,837 B2
(45) Date of Patent: Apr. 25, 2017

(54) HOT WATER SUPPLY DEVICE

(71) Applicant: NORITZ CORPORATION, Hyogo (JP)

(72) Inventors: Masato Doyama, Kobe (JP); Eiji Kanki, Kobe (JP); Yu Fujimoto, Kobe (JP); Shingo Tateishi, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 127 days.

(21) Appl. No.: 14/663,350

(22) Filed: Mar. 19, 2015

(65) Prior Publication Data

US 2015/0338130 A1 Nov. 26, 2015

(30) Foreign Application Priority Data

May 26, 2014 (JP) ..... 2014-108508

(51) Int. Cl.

| | |
|---|---|
| ***F24H 9/20*** | (2006.01) |
| ***F24D 19/00*** | (2006.01) |
| ***F28F 27/00*** | (2006.01) |
| *F24H 1/14* | (2006.01) |
| *F24H 9/00* | (2006.01) |

(52) U.S. Cl.

CPC ..... *F24H 9/2035* (2013.01); *F24D 19/0092* (2013.01); *F28F 27/00* (2013.01); *F24H 1/145* (2013.01); *F24H 9/0042* (2013.01)

(58) Field of Classification Search

CPC .... F24D 19/0092; C02F 5/00; F23N 2025/06; F24H 9/2035; F24H 1/124; F24H 1/145

USPC ..... 122/14.2, 15.1, 18.1, 31.1, 33

See application file for complete search history.

(56) References Cited

U.S. PATENT DOCUMENTS

| | | | | |
|---|---|---|---|---|
| 2014/0202680 | A1* | 7/2014 | Kusachi | F23N 1/082 165/287 |
| 2015/0144074 | A1* | 5/2015 | Fujimoto | F28G 15/003 122/14.21 |
| 2016/0033171 | A1* | 2/2016 | Mase | F24H 1/145 122/14.3 |

FOREIGN PATENT DOCUMENTS

| | | | |
|---|---|---|---|
| JP | 2003-254615 | A | 9/2003 |
| JP | 2008-215657 | A | 9/2008 |
| JP | 4854020 | B2 | 1/2012 |
| JP | 2013-160488 | A | 8/2013 |

* cited by examiner

*Primary Examiner* — Gregory A Wilson
(74) *Attorney, Agent, or Firm* — Studebaker & Brackett PC

(57) ABSTRACT

A hot water supply device 1 includes a fin-and-tube type heat exchanger (21) that applies heat to fresh water with combustion gases, and a heat exchanger casing (22) for housing the heat exchanger (21), and in order to be able reliably to determine by a simple method whether the hot water supply device is clogged by lime scale, there are provided a temperature detector (31) for detecting the surface temperature of the heat exchanger casing (22) and a control unit (7) that determines that scale has built up in the heat exchange tubing (27) of the heat exchanger (21) when the temperature detected by this temperature detector (31) is greater than a set temperature.

9 Claims, 5 Drawing Sheets

HOT WATER SUPPLY DEVICE

BACKGROUND OF THE INVENTION

The present invention relates to a hot water supply device, and in particular relates to a hot water supply device that is endowed with a function of deciding whether or not lime scale has built up within the heat exchange tubing of a heat exchanger and has caused clogging.

From the past, hot water supply devices of various types employing heat sources of various types, such as gas-powered hot water supply devices, electricity-powered hot water supply devices, oil-powered hot water supply devices, and so on, have been widespread for general household use. In particular, a typical such gas-powered hot water supply device incorporates a blower fan that sucks in air from the external atmosphere for combustion, a burner unit that mixes the air with fuel gas and combusts the resulting mixture, a heat exchanger that exchanges heat between the resulting high temperature combustion gases and water flowing in heat exchange tubing and thereby heats up the water, an exhaust pipe for discharging the exhaust after the above heat exchange to the external atmosphere, and so on.

Usually a fin-and-tube type heat exchanger that includes the above described heat exchange tubing and a plurality of fins that are fixed to the heat exchange tubing for conducting heat exchange with the combustion gases is applied as the heat exchanger described above, with either stainless steel or copper being normally used as the material for the heat exchange tubing and the fins.

However, if a mains water whose hardness is high is used for the fresh water that is supplied to the heat exchanger, then lime scale is apt to be created by combination between calcium or magnesium or the like contained in the mains water and ions of carbonic acid or sulfuric acid, and there is a problem that clogging by scale may occur due to the lime scale undesirably building up within the heat exchange tubing of the heat exchanger, in which case the efficiency of heat exchange in the heat exchanger will deteriorate. Moreover, when the hot water supply device is used over the long term, fin clogging may take place due to soot or the like adhering to the fins, and this also may cause a problem with deterioration of the heat exchange efficiency of the heat exchanger.

There is a fear of damage to the heat exchanger if usage of the hot water supply device continues in the state in which the clogging with scale or fin clogging has occurred, and accordingly it is necessary to perform maintenance in order to eliminate the lime scale or the soot if an anomaly such as clogging with scale or fin clogging has taken place. Due to this, in the past, hot water supply devices have been endowed with a function of detecting an anomaly such as clogging with lime scale or the like.

Here, as prior art documents, the following four publications may be mentioned:

Patent Document #1: JP Patent Publication 4854020.

Patent Document #2: JP Laid Open Pat. Publication 2003-25461.

Patent Document #3: JP Laid Open Pat. Publication 2013-160488.

Patent Document #4: JP Laid Open Pat. Publication 2008-215657.

For example, with the devices described in Patent Documents #1 through #3, a technique is disclosed of determining that clogging with scale has taken place on the basis of heat rise an increase of the temperature of the warm water after shutoff of combustion. Moreover, with the device for heating to water described in Patent Document #4, a technique is disclosed in which the level of combustion is forcibly reduced when it is detected during combustion operation that the efficiency of heat exchange has dropped, and after this reduction the detected heat exchange efficiency is compared with a standard efficiency, and a determination is made as to whether the cause of the deterioration of heat exchange efficiency is clogging with lime scale or clogging of the fins.

However, if anomaly determination is performed on the basis of increase of the temperature of the remaining warm water that takes place due to heat rise after shutoff of combustion, as in the case of Patent Documents #1 through #3, then it is not possible to determine the cause of deterioration of heat efficiency accurately, i.e. to determine whether this deterioration has occurred due to poor heat exchange because of clogging with lime scale or due to poor heat exchange because of fin clogging, and accordingly, when maintenance is performed or countermeasures are instituted, there is a fear that labor may be wastefully employed. Furthermore there is also the problem that, if the amount of combustion just before combustion is stopped is low and the immediate hot water system is operating, then it is not possible to take advantage of elevation of the temperature of the remaining warm water due to heat rise after shutoff for the determination of an anomaly.

Moreover, although, in the case of the device for heating water described in Patent Document #4, a determination is performed during combustion operation for specifying whether the cause of poor efficiency is clogging with lime scale or fin clogging, since the amount of combustion is forcibly reduced in order to perform specification of the cause of poor efficiency during combustion operation with the technique of Patent Document #4 even when the operational state of supplying hot water is normal, accordingly the problem arises that the hot water supply amount and/or the hot water supply temperature may undesirably fluctuate, which would be contrary to the intentions of the user.

The object of the present invention is to provide a hot water supply device that is capable of reliably determining clogging by scale with a simple method.

SUMMARY OF THE INVENTION

The present invention presents a hot water supply device comprising a heat exchanger, for applying heat to water with combustion gases, including a plurality of fins, a heat exchange tubing and a heat exchanger casing; a temperature detector for detecting a surface temperature of the heat exchanger casing; and a determination means that determines that scale has built up in a heat exchange tubing of the heat exchanger when a temperature detected by the temperature detector is greater than a set temperature.

According to a preferable first aspect of the present invention, the temperature detector is disposed on a surface of the heat exchanger surface above a combustion unit that always performs combustion during hot water supply operation.

According to a preferable second aspect of the present invention, the temperature detector is disposed on a surface of the heat exchanger casing in a neighborhood of a downstream side portion of the heat exchange tubing that is closest to the combustion unit.

According to a preferable third aspect of the present invention, there is provided with a notifying means for notifying a user of building up of scale determined by the determination means.

DETAILED DESCRIPTION

In the following, embodiments of the present invention will be explained with reference to the drawings.

First, the overall structure of a hot water supply device 1 according to the present invention will be explained.

Figure 1:
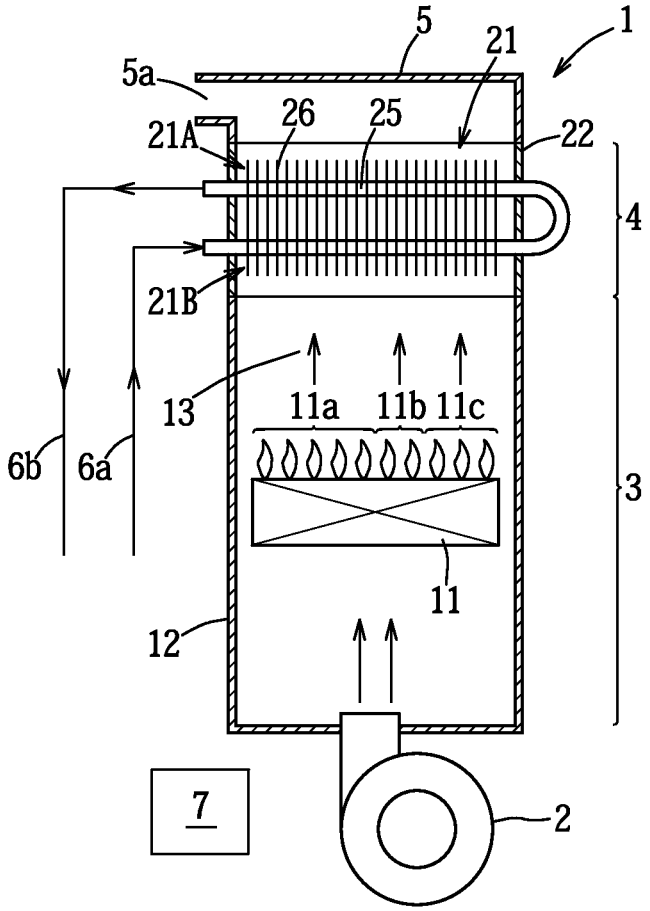
FIG. 1 is a general structural drawing showing a hot water supply device according to an embodiment of the present invention.
Figure 2:
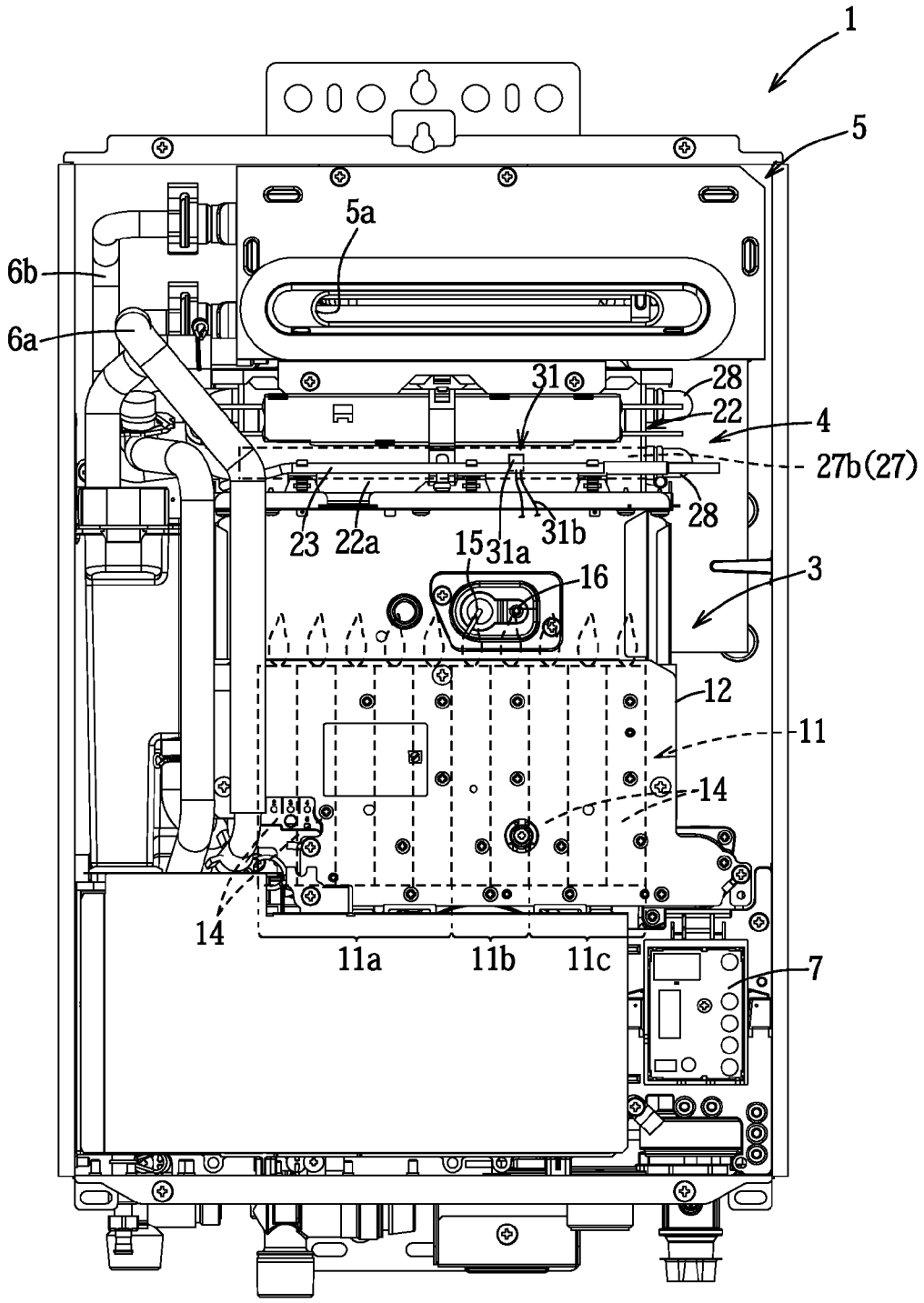
FIG. 2 is an elevation view of the hot water supply device.
Figure 3:
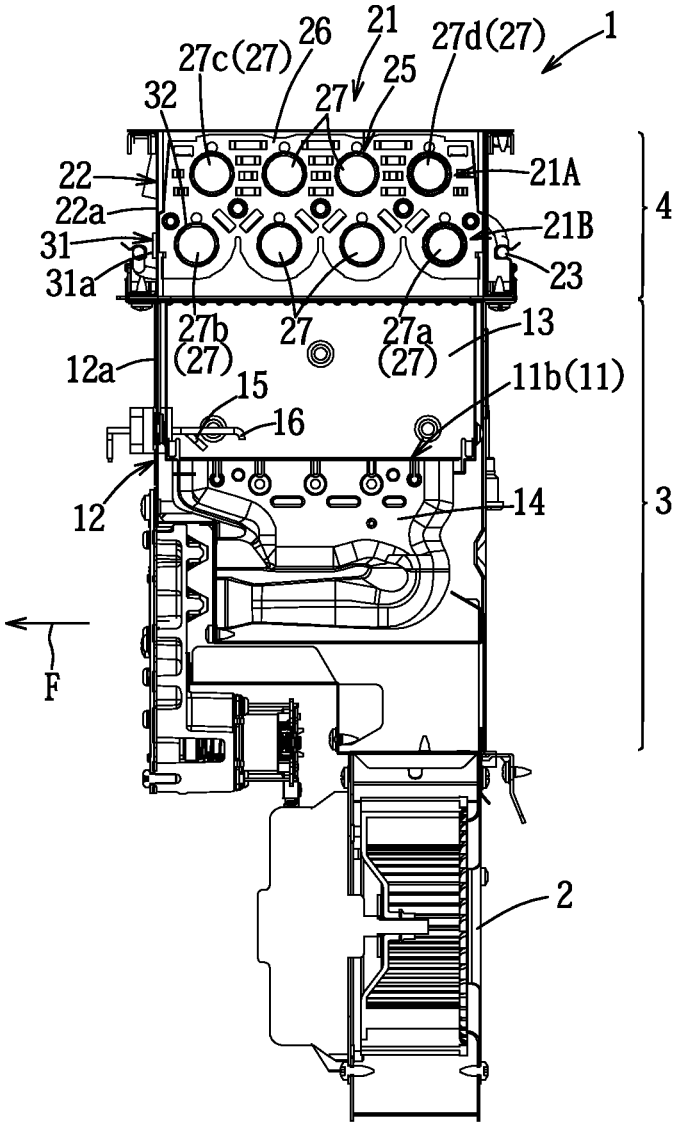
FIG. 3 is a vertical sectional view of the hot water supply device, particularly showing a heat exchanger unit and lower side equipments thereof.
Figure 4:
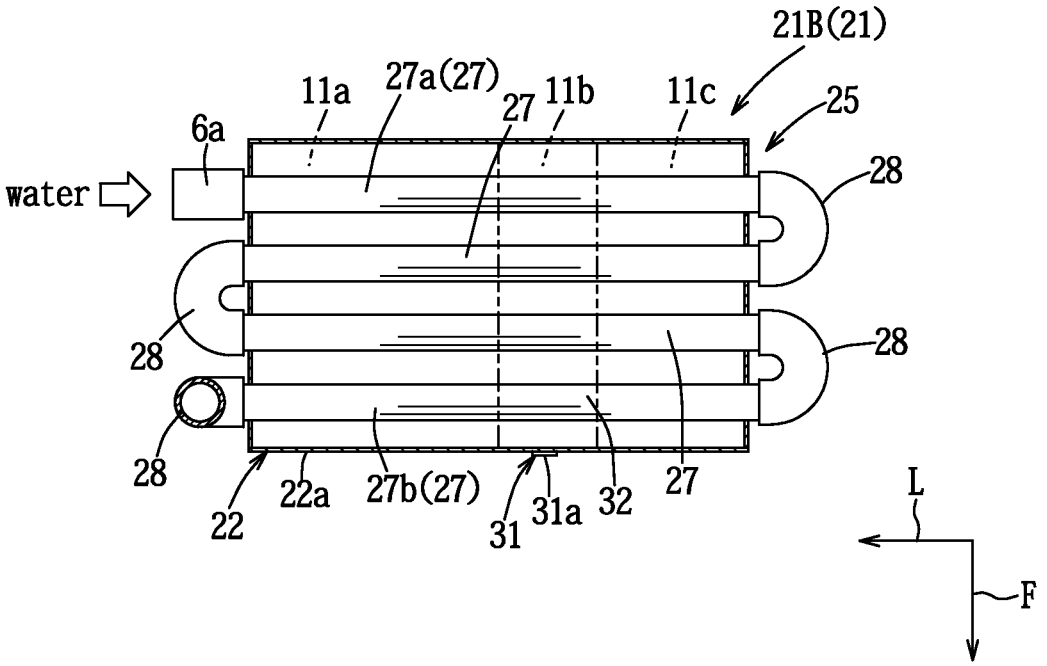
FIG. 4 is a plan view of a lower heat exchange region of the heat exchanger unit.

As shown in FIGS. 1 through 4, this hot water supply device 1 is applied as a heat supply device such as a hot water supply equipment or a room heating device, and is built as a gas-powered hot water supply device that performs application of heat to cold water or to warm water by combusting fuel gas and by employing heat included in the resulting combustion gases. In FIGS. 3 and 4, arrow F shows "frontward", and arrow L shows "leftward".

In detail, this hot water supply device 1 comprises a blower fan 2 for supplying air for combustion, a burner section 3 that combusts fuel gas, a heat exchanger 4 that exchanges heat between the resulting combustion gases from the burner section 3 and water, an exhaust casing 5 that vents the combustion gases as exhaust after the aforementioned heat exchange by the heat exchanger 4, conduits of various types such as an inlet water conduit 6*a* and an outlet water conduit 6*b* and so on, a control unit 7 that controls the operation of various sections of the hot water supply device, etc.

The burner section 3 comprises a burner unit 11 that mixes together fuel gas supplied from a fuel gas supply conduit (not shown in the figures) and air for combustion supplied from the blower fan 2 and combusts this mixture, a burner casing 12 in which the burner unit 11 is contained, a combustion space 13 defined above the burner unit 11 within the burner casing 12, and so on. The burner casing 12 is formed as a rectangular parallelepiped that is open upwards. And the blower fan 2 is provided to the lower end portion of the burner casing 12.

The burner unit 11 comprises ten combustion tubes 14 that are arranged parallel to one another in the left-right direction, and is built as a multi-stage type burner having, for example, three combustion units 11*a* through 11*c* (refer to FIGS. 1, 2, and 4). The combustion units 11*a* through 11*c*, for example, may respectively include five, two, and three of the combustion tubes 14, and are connected to respectively corresponding fuel supply conduits. Combustion by each of these combustion units 11*a* through 11*c* can be controlled individually by the control unit 7, so that the number of these combustion units 11*a* through 11*c* that are operated to perform combustion, and their outputs, can be adjusted so as to correspond to various types of combustion operation.

During hot water supply operation, for example, combustion operation may be changed over to any of four combustion stages: a first combustion stage in which only the two combustion tubes 14 of the center combustion unit 11*b* are operated to perform combustion; a second combustion stage in which the five combustion tubes 14 of the center and right side combustion units 11*b*, 11*c* are operated to perform combustion; a third combustion stage in which the seven combustion tubes 14 of the left side and center combustion units 11*a*, 11*b* are operated to perform combustion; and a fourth combustion stage in which all the ten combustion tubes 14 of the left side, center, and right side combustion units 11*a*, 11*b*, and 11*c* are operated to perform combustion. Accordingly it will be noted that the center combustion unit 11*b* corresponds to a combustion unit that is always performing combustion while hot water supply is being performed.

As shown in FIGS. 2 and 3, an igniter 15 and a flame rod 16 are both disposed in the combustion space 13 above the combustion unit 11*b* of the burner unit 11. The igniter 15 and the flame rod 16 are both mounted to the rightward portion of a central portion in the left-right direction of a front side plate 12*a* of the burner casing 12 (i.e. to the portion corresponding to the combustion unit 11*b*). The flame rod 16 is attached next to the right side of the igniter 15.

The igniter 15 is attached so as to project into the combustion space 13 while extending downward at an angle, and is a device for setting fire to the fuel air mixture gas ejected from the burner unit 11 by generating an ignition spark between itself and an ignition target provided on the burner unit 11.

The flame rod 16 is attached so as to project into the combustion space 13 while extending straight, and is a device for detecting whether or not a flame is present by applying an AC voltage between itself and the flame created in the burner unit 11, thus detecting DC current flowing from the flame rod 16 to the flame by taking advantage of conductivity of the flame and of rectification due to ionization of the flame.

As shown in FIGS. 1 through 4, the heat exchanger 4 comprises a heat exchanger section 21 that collects heat in the combustion gases, and a heat exchanger casing 22 that contains the heat exchanger section 21. An exhaust casing 5 having an exhaust aperture 5*a* that opens frontward is provided at the upper end portion of the heat exchanger casing 22. The heat exchanger casing 22 is built in a rectangular frame shape as seen in plan view. The lower end portion of the heat exchanger casing 22 and the upper end portion of the burner casing 12 are joined together by fastening with caulking or screws. A temperature fuse 23 is provided around the heat exchanger casing 22 (refer to FIGS. 2 and 3).

The heat exchanger section 21 is built as a fin-and-tube type heat exchanger, and comprises heat exchange tubing 25, a plurality of fins 26 that are fixed to the heat exchange tubing 25 so as to be capable of heat exchange therewith, and so on. The heat exchange tubing 25 and the fins 26 are made from copper, but the use of this material is not to be considered as being necessarily limitative; they could alternatively be made of stainless steel, for example.

As shown in FIGS. 1 and 3, in the interior of the heat exchanger casing 22, the heat exchanger section 21 is built in two stages, and comprises an upper heat exchange region 21A (the downstream side with respect to the flow of combustion gases) which is connected to the lower end of the exhaust casing 5, and a lower heat exchange region 21B (the upstream side with respect to the flow of combustion gases) which is communicated to the upper end of the combustion space 13.

The heat exchange tubing 25 comprises a plurality of straight tube portions 27 that are arranged parallel to one another in two stages, and a plurality of link tube portions 28 that link together the end portions of the plurality of straight tube portions 27. Four of the straight tube portions 27 are disposed in the upper heat exchange region 21A, and four of the straight tube portions 27 are disposed in the lower heat exchange region 21B, with each of the heat exchange tubing 25 in the upper heat exchange region 21A and in the lower heat exchange region 21B being configured in a meandering or serpentine shape as seen in plan view (refer to FIG. 4).

The downstream side end portion of the inlet water conduit 6*a* is connected to a straight tube portion 27*a* at the upstream side (and at the rear side) of the lower heat exchange region 21B; a straight tube portion 27*b* at the downstream side (and at the front side) of the lower heat exchange region 21B is connected via a link tube portion 28 to a straight tube portion 27*c* at the upstream side (and at the front side) of the upper heat exchange region 21A; and a straight tube portion 27*d* at the downstream side (and at the rear side) of the upper heat exchange region 21A is connected to the upstream side end portion of the outlet water conduit 6*b*.

In this hot water supply device 1, fuel gas from a fuel supply conduit is supplied to the burner unit 11 and air for combustion is supplied from the blower fan 2, the fuel air mixture gas resulting from the fuel gas and the air being mixed together is combusted and flame is generated in the combustion space 13, the combustion heat of this flame (now contained in the resulting combustion gases) passes from the combustion space 13 into the heat exchanger section 21 and some of this combustion heat is transferred to the cold water in the heat exchanger section 21, and thereafter the exhaust is vented via the exhaust casing 5 and out from the exhaust aperture 5*a* to the external atmosphere.

On the other hand, when water is supplied to the inlet conduit 6*a* of the heat exchanger section 21 from an external water source, first this water flows into the heat exchange tubing 25 in the lower heat exchange region 21B of the heat exchanger section 21 and next it flows to the heat exchange tubing 25 in the upper heat exchange region 21A of the heat exchanger section 21, and during this flow the water is heated up due to transfer of heat in the heat exchanger section 21 as described above, after which it flows out as hot water from the outlet water conduit 6*b* to the exterior.

Next, a temperature detector 31 will be explained.

As shown in FIGS. 2 and 3, the hot water supply device 1 is provided with a temperature detector 31 for detecting the surface temperature of the front surface of the heat exchanger casing 22. The temperature detector 31 is disposed directly above the combustion unit 11*b*, which is the one that is always performing combustion during hot water supply operation, and moreover is disposed on the front surface of the heat exchanger casing 22 of the heat exchanger section 21, in the neighborhood of the downstream side of the heat exchange tubing 25 in the lower heat exchange region 21B which is closest to the combustion unit 11*b*.

In other words, the temperature detector 31 is disposed in the neighborhood of the passage portion 32 of the straight tube portion 27*b* on the downstream side of the lower heat exchange region 21B, directly above the combustion unit 11*b* (refer to FIG. 4), and is disposed on the front surface of the front side plate 22*a* of the heat exchanger casing 22 so as to be positioned directly above the portion of the front side plate 12*a* of the burner casing 12 where the flame rod 16 is attached (refer to FIGS. 2 and 3).

The temperature detector 31 is built as a per se known temperature detection sensor incorporating a thermocouple 31*a* and a pair of lead wires 31*b* extending from the thermocouple 31*a* and so on, and is attached by brazing or adhesive tape. The pair of lead wires 31*b* are connected to the control unit 7, so that a detection signal based on the front surface temperature of the front side plate 12*a* of the heat exchanger casing 22 is supplied from the temperature detector 31 to the control unit 7.

Next, the control unit 7 will be explained.

As shown in FIGS. 1 and 2, the control unit 7 performs overall control of the hot water supply device 1, and is electrically connected to sensors of various types and is adapted to receive their detection signals. The control unit 7 performs drive control of the blower fan 2 and the burner unit 11 and so on and executes hot water supply operation, on the basis of the detection signals received from these sensors of various types, such as a signal specifying the temperature for the hot water supply which is set by a remote controller or the like, a signal specifying the amount of hot water to be supplied which is sent from a hot water supply faucet, and so on.

Next, the operational control in the present invention for determining on clogging by lime scale will be explained.

If the temperature detected by the temperature detector 31 (i.e. the temperature of the front surface of the heat exchanger casing 22) becomes higher than a set temperature, then it is possible for the control unit 7 (which corresponds to the "determination means") to perform scale clogging determination operational control in which it is determined that scale has built up within the heat exchange tubing 25 of the heat exchanger section 21.

Now, this scale clogging determination operational control that is automatically executed by the control unit 7 during hot water supply operation by the hot water supply device 1 will be explained in detail on the basis of the flow chart of FIG. 5. It should be understood that the reference symbols Si (where i=1, 2, ..) in the figure denote the corresponding steps. The control program for this scale clogging determination operational control is stored in advance in the control unit 7.

Figure 5:
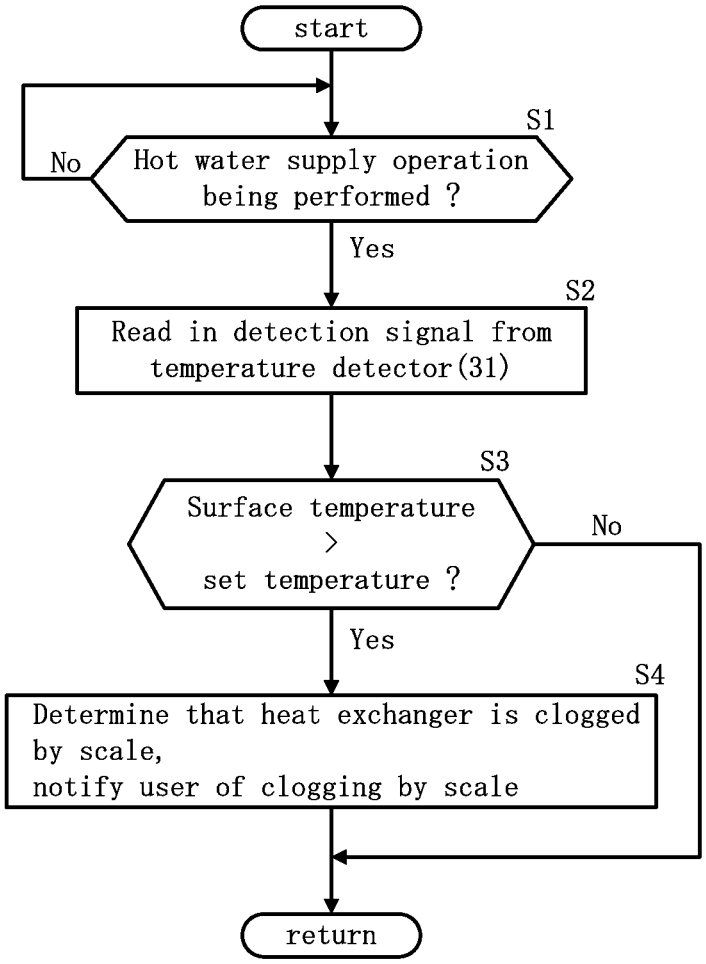
FIG. 5 is a flow chart for operational control for determination of clogging by lime scale.

When this control starts, in the flow chart of FIG. 5, initially in a step S1 the control unit 7 makes a decision as to whether or not the hot water supply device 1 is currently performing hot water supply operation. Here, if the hot water supply device 1 is currently performing hot water supply operation, i.e. if the control unit 7 is receiving a signal based on hot water supply operation, then the result of this decision in the step S1 is affirmative and the flow of control proceeds to the step S2, whereas if the result of the decision in the step S1 is negative the flow of control loops back to the same step S1, which is then repeated.

Next in the step S2 the control unit 7 reads in the detection signal from the temperature detector 31 and calculates the temperature of the front surface of the front side plate 22*a* of the heat exchanger casing 22 on the basis of this detection signal, and then the flow of control proceeds to a step S3.

Next in the step S3 the control unit 7 makes a decision as to whether or not the temperature of the front surface of the heat exchanger casing 22 is greater than a set temperature (for example, around 180° C. to 200° C.), and if the front surface temperature is greater than this set temperature then an affirmative decision is reached in this step S3 and the flow of control proceeds to a step S4. But if the front surface temperature is less than or equal to the set temperature, then a negative decision is reached in this step S3 and it is decided that the heat exchanger section 21 is functioning normally, and the flow of control returns from this routine. It should be understood that the set temperature is not limited to being as specified above; it could be varied as appropriate.

Here, during hot water supply operation, although combustion operation is performed while adjusting the burner unit 11 to any appropriate one of four stages of combustion according to the amount of heat requested as described above, the two combustion tubes 14 of the center combustion unit 11*b* are those that are capable of performing the minimum amount of combustion, and these two combustion tubes 14 always perform combustion during hot water supply operation.

The above fact implies that, in this heat exchanger section 21, the portions of the plurality of straight tube portions 27 in the lower heat exchange region 21B that are positioned directly above the combustion unit 11*b* are always directly exposed to and seared by the flame from the two combustion tubes 14 of the combustion unit 11*b*. Moreover, since heat is applied to the water that is supplied to the heat exchange tubing 25 as it flows meanderingly from the upstream side straight portion 27*a* toward the downstream side straight tube portion 27*b*, accordingly it is the warm water in this straight tube portion 27*b* in the lower heat exchange region 21B whose temperature is the most abruptly elevated.

Since, due to this, there is a possibility that during hot water supply operation the temperature of the warm water in the passage portion 32 of the straight tube portion 27*b*, which is the portion among the plurality of straight tube portions 27 that is always exposed to and seared by the flame, will become the highest, accordingly it is easier for scale to build up in this portion, as compared to the other portions. If clogging by scale occurs in the passage portion 32 of the straight tube portion 27*b*, then, due to poor heat transfer in this portion of the heat exchanger section 21, the temperature of the front surface of the heat exchanger casing 22 in the neighborhood of this passage portion 32 will abnormally rise to around 180° C. to 200° C. Since the front surface temperature of the heat exchanger casing 22 is maintained at around 120° C. if the heat exchanger section 21 is in a normal state, accordingly it is possible to ascertain whether clogging with scale has occurred by taking advantage of this front surface temperature.

It should be understood that, in the case of fin clogging, it becomes difficult for the combustion gases to flow in between the fins 26 of the heat exchanger section 21, and the amount of heat in the combustion gases that is retrieved by the heat exchanger section 21 decreases, and, since the combustion gases remains at high temperature and are exhausted at high temperature, accordingly the temperature of the heat exchanger section 21 does not become so much elevated, and also the temperature of the front surface of the heat exchanger casing 22 does not become particularly elevated. By contrast, while in the case of clogging by scale the temperature of the heat exchanger section 21 rises due to the combustion gases, since heat transfer to the water flowing in the heat exchange tubing 25 of the heat exchanger section 21 cannot be performed with good efficiency, accordingly the temperature of the heat exchanger section 21 itself rises abnormally, and together therewith the front surface temperature of the heat exchanger casing 22 also rises.

Next, in the step S4, the control unit 7 determines that clogging of the heat exchanger section 21 by scale is taking place, and notifies the user of this clogging with lime scale via a display on the remote controller or by audio; and then the flow of control returns from this routine. It should be understood that it would be possible to continue the hot water supply operation after having notified the user of clogging by scale, or alternatively it would also be possible to terminate the hot water supply operation directly after having thus notified the user; or it would also be possible to terminate the hot water supply operation after a predetermined time period has elapsed from when clogging by lime scale has been notified to the user.

Next, the operation of the hot water supply device 1 described above and the beneficial effects that it provides will be explained.

Since this hot water supply device 1 is equipped with the temperature detector 31 for detecting the surface temperature of the heat exchanger casing 22, and with the control unit 7 that determines that lime scale has built up in the heat exchange tubing 25 of the heat exchanger section 21 when the temperature detected by the temperature detector 31 is greater than the set temperature, accordingly, if the surface temperature of the heat exchanger casing 22 has become greater than the set temperature, it is possible to ascertain that clogging of the heat exchanger by scale has occurred.

Since, in the case of fin clogging, it becomes difficult for the combustion gases to flow in between the fins 26 of the heat exchanger section 21, and the amount of heat in the combustion gases that is retrieved by the heat exchanger section 21 decreases, and since the combustion gases remain at high temperature and are exhausted at high temperature, accordingly the temperature of the heat exchanger section 21 does not become elevated, and also the temperature of the front surface of the heat exchanger casing 22 does not become elevated. By contrast to the above, while in the case of clogging by lime scale the temperature of the heat exchanger section 21 due to the combustion gases rises, since heat transfer to the water flowing in the heat exchange tubing 25 of the heat exchanger section 21 cannot be performed with good efficiency, accordingly the temperature of the heat exchanger section 21 itself rises abnormally, and together therewith the front surface temperature of the heat exchanger casing 22 also rises.

In other words, since it is possible to distinguish between clogging of the water flow by scale and clogging of the air flow through the fins by directly measuring the temperature of the front surface of the heat exchanger casing 22 with the temperature detector 31, and by determining on anomalous temperature elevation of the heat exchanger casing 22 caused by heat transfer by the heat exchanger section 21 being hampered due to clogging of the heat exchanger section 21 by lime scale, accordingly it is possible to determine on clogging by scale accurately even during combustion operation, as compared with the method of determining on clogging according to elevation of the temperature of the warm water after combustion has stopped, or according to change of the heat exchange efficiency during combustion operation. Moreover, when it has been determined that clogging by lime scale is taking place, it is possible to prevent fluctuations of the hot water supply amount or fluctuations of the hot water supply temperature taking place against the intentions of the user.

Furthermore, since the temperature detector 31 is provided on the front surface of the heat exchanger casing 22 in the neighborhood of the downstream side portion of the heat exchange tubing 25 of the heat exchanger section 21 that is closest to and directly above that combustion unit which is always performing combustion during hot water supply operation, accordingly it is possible reliably and also rapidly to ascertain the occurrence of clogging with lime scale by detecting anomalous elevation of the temperature of the heat exchanger casing 22 using the temperature detector 31 which is provided in the neighborhood of a spot on the heat exchange tubing 25 for which the possibility is high that clogging by scale will take place.

Yet further, since the temperature detector 31 is provided at a spot on the heat exchanger casing 22 such as described above, and since the decision as to whether clogging by lime scale has taken place is performed by employing the temperature of the front surface of the heat exchanger casing 22, accordingly it is possible to make a determination of clogging by scale in a simple and easy manner even during combustion operation, it is possible to make this determination even in the case that the amount of combustion being performed by the burner unit is minimum, it is possible to fit this system to a hot water supply device that provides immediate hot water supply system, and it is also possible for this system to be adapted to a hot water supply device of high capacity.

Next, examples in which the embodiment described above is partially altered will be explained.

[1] While the temperature detector 31 of the embodiment described above was provided on the front surface of the front side plate 22*a* of the heat exchanger casing 22 in the neighborhood of the passage portion 32 of the straight tube portion 27*b*, the temperature sensor is not necessarily limited to being positioned in this position; it will be quite acceptable to make some appropriate alteration in the position of the temperature sensor, although it is preferable for it to be located in the neighborhood of that passage portion of the heat exchange tubing 25 for which it is considered that the possibility of the temperature of the warm water flowing therein becoming elevated when clogging by lime scale has occurred is highest.

[2] While the temperature sensor (temperature detector) of the embodiment described above was built with the thermocouple 31*a*, this construction is not to be considered as necessarily being limitative; it would also be acceptable to employ a sensor built with a thermistor, or to employ a structure built with an infra-red radiation sensor, and other appropriate variations would also be possible.

[3] While the burner unit 11 of the embodiment described above was built as a multi-stage type burner unit including the three combustion units 11*a* through 11*c* and incorporated the ten combustion tubes 14 in all, this particular construction is not a necessary feature of the present invention; it would be possible to change the number of combustion units in the burner unit and the number of combustion tubes in each of the combustion units, as appropriate.

[4] Apart from the above, it would be possible for a person of ordinary skill in the relevant art to implement various alterations or additions to the embodiment described above without deviating from the scope of the present invention, and the present invention is to be considered as including all such altered or augmented embodiments.

The invention claimed is:

1. A hot water supply device comprising;

a burner unit;

a heat exchanger, for applying heat to water with combustion gases supplied from said burner unit, including a plurality of fins, a heat exchange tubing and a heat exchanger casing;

a temperature detector for detecting a surface temperature of the heat exchanger casing; and a determination means that determines that scale has built up in said heat exchange tubing of said heat exchanger when a temperature detected by said temperature detector is greater than a set temperature;

wherein said burner unit comprises a plurality of combustion tubes that are disposed in a predetermined arranging direction, said plurality of combustion tubes including at least one always combusting combustion tube that is always performing combustion while hot water being supplied;

said heat exchanger comprises a lower heat exchange region that is disposed so as to face directly to said burner unit from above, and an upper heat exchange region that is disposed on an upper side of said lower heat exchange region and heats hot water heated by said lower heat exchange region;

said heat exchange tubing of said lower heat exchange region is constituted by means of connecting, with a plurality of U-shaped link tube portions, a plurality of straight tube portions extending toward said arranging direction that are disposed at given intervals in a direction orthogonal to said arranging direction; and said temperature detector is disposed on a surface portion of said heat exchanger casing in a neighborhood of a downstream side portion in a hot water flow in said lower heat exchange region, said surface portion being closest to said always combusting combustion tube.

2. The hot water supply device according to claim 1; wherein the temperature detector is disposed on a surface of the heat exchanger casing above a combustion unit that always performs combustion during hot water supply operation.

3. The hot water supply device according to claim 2, wherein there is provided a notifying means for notifying a user of building up of scale determined by the determination means.

4. The hot water supply device according to claim 2; wherein the temperature detector is disposed in a neighborhood of a downstream side portion of the heat exchange tubing that is closest to the combustion unit.

5. The hot water supply device according to claim 4; wherein there is provided a notifying means for notifying a user of building up of scale determined by the determination means.

6. The hot water supply device according to claim 1, wherein the temperature detector is disposed on a surface of the heat exchanger casing in a neighborhood of a downstream side portion of the heat exchange tubing that is closest to the combustion unit.

7. The hot water supply device according to claim 6, wherein there is provided a notifying means for notifying a user of building up of scale determined by the determination means.

8. The hot water supply device according to claim 1, wherein there is provided a notifying means for notifying a user of building up of scale determined by the determination means.

9. The hot water supply device according to claim 1;

wherein said temperature detector detects said surface temperature of said heat exchanger casing while hot water supply is being performed.

* * * * *